US011353017B2

(12) United States Patent
Surjaatmadja et al.

(10) Patent No.: US 11,353,017 B2
(45) Date of Patent: Jun. 7, 2022

(54) INTENSITY MODIFIABLE INTENSIFIER PUMP

(71) Applicant: Halliburton Energy Services, Inc., Houston, TX (US)

(72) Inventors: Jim Basuki Surjaatmadja, Duncan, OK (US); Timothy H. Hunter, Duncan, OK (US); Stanley V. Stephenson, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/769,234

(22) PCT Filed: Feb. 14, 2018

(86) PCT No.: PCT/US2018/018121

§ 371 (c)(1),
(2) Date: Jun. 2, 2020

(87) PCT Pub. No.: WO2019/160538

PCT Pub. Date: Aug. 22, 2019

(65) Prior Publication Data

US 2020/0340461 A1 Oct. 29, 2020

(51) Int. Cl.

| | |
|---|---|
| ***F04B 49/18*** | (2006.01) |
| ***F04B 5/00*** | (2006.01) |
| ***F04B 15/02*** | (2006.01) |

(52) U.S. Cl.

CPC ..... *F04B 49/18* (2013.01); *F04B 5/00* (2013.01); *F04B 15/02* (2013.01)

(58) Field of Classification Search

CPC .... F04B 49/18; F04B 5/00–02; F04B 39/005; F04B 53/14; F15B 3/00; F16J 1/00–24

USPC ..... 92/6 R, 6 D; 417/225–227, 238, 274

See application file for complete search history.

(56) References Cited

U.S. PATENT DOCUMENTS

| | | | | | |
|---|---|---|---|---|---|
| 209,086 | A | * | 10/1878 | Stucky | F04B 9/14 92/6 R |
| 753,530 | A | * | 3/1904 | Eyck | F04B 9/14 92/6 R |
| 755,035 | A | * | 3/1904 | O'Brien | F04B 9/14 92/6 R |
| 1,165,400 | A | * | 12/1915 | Dreisbach | F04B 9/14 92/6 R |

(Continued)

FOREIGN PATENT DOCUMENTS

| | | | | |
|---|---|---|---|---|
| EP | 3171024 A1 | * | 5/2017 | F04B 33/005 |
| FR | 1148819 A | * | 12/1957 | F04B 49/18 |

OTHER PUBLICATIONS

Pressure Intensifiers, by Hanchen, published 2015, URL: https://web.archive.org/web/20150603000509/https://www.haenchen-hydraulic.com/pressure-transformer/pressure-intensifier.html (Year: 2015).*

(Continued)

*Primary Examiner* — Devon C Kramer
*Assistant Examiner* — Thomas Fink
(74) *Attorney, Agent, or Firm* — McGuireWoods LLP

(57) ABSTRACT

An intensifier pump includes a piston including at least two selectable piston diameters. Additionally, the intensifier pump includes a plunger that in operation interacts with the piston. The plunger includes a plunger diameter that is smaller than each of the at least two selectable piston diameters.

20 Claims, 6 Drawing Sheets

(56) References Cited

U.S. PATENT DOCUMENTS 1,263,401 A * 4/1918 Fraser ..... F04B 5/02 417/487
3,112,705 A * 12/1963 Chlebowski ..... F04B 49/18 417/214
3,981,622 A * 9/1976 Hall ..... F01L 25/063 417/46
4,452,126 A * 6/1984 Tomov ..... F01B 29/10 123/193.6
4,470,771 A * 9/1984 Hall ..... F04B 9/1178 417/342
4,555,220 A * 11/1985 Hall ..... G05D 16/2097 417/342
4,599,861 A 7/1986 Beaumont
4,733,568 A * 3/1988 Koopmans ..... E02D 1/022 73/784
6,086,338 A 7/2000 Higgins
6,158,967 A 12/2000 Dupre
6,915,731 B2 * 7/2005 Mischker ..... F01L 1/46 92/6 R
7,353,746 B2 * 4/2008 Kutella ..... F04B 49/18 92/61
2007/0221178 A1 9/2007 Feinleib
2008/0099577 A1 5/2008 Feinleib
2008/0193299 A1 8/2008 Oglesby
2009/0317267 A1 12/2009 Gill et al.
2011/0083643 A1 4/2011 Sturman et al.
2011/0176940 A1 7/2011 Ellis et al.
2012/0205469 A1 8/2012 Shen et al.
2014/0072453 A1 3/2014 Vandergon et al.
2014/0109760 A1 4/2014 Dietzel et al.
2014/0131154 A1 5/2014 Ganzel
2015/0192117 A1 7/2015 Bridges
2016/0053749 A1 2/2016 Hunter

OTHER PUBLICATIONS

International Search Report and Written Opinion dated Nov. 9, 2018; International PCT Application No. PCT/US2018/018121.

* cited by examiner

INTENSITY MODIFIABLE INTENSIFIER PUMP

BACKGROUND

The disclosure generally relates to intensifier pumps. More specifically, the disclosure relates to intensifier pumps including mechanisms to modify an output intensity of the intensifier pump.

Intensifier pumps are widely used in applications that rely on delivery of high pressure fluid. Generally, the intensifier pumps are tuned to provide a specific pressure ratio between a low pressure side of the intensifier pump and a high pressure side of the intensifier pump. This ratio is associated with a difference in diameter between a larger diameter low pressure piston and a smaller diameter high pressure plunger. Accordingly, if a change to an output pressure is desired, an operator is required to change the pressure of the fluid provided at the input, or to change out the intensifier pump with a different pressure ratio.

Such changes to the intensifier pump may increase costs associated with the delivery of high pressure fluid. For example, an operator may keep several intensifier pumps on site with differing pressure ratios, which leads to increased equipment costs. Additionally, the time required to replace an intensifier pump with another intensifier pump with a different pressure ratio may also contribute to an increase in personnel costs. Changing the input fluid pressure at the intensifier pump may also provide difficulties for an operator in the field when the operator desires to change the output fluid pressure without changing out the intensifier pump. For example, changing the input fluid pressure may require additional equipment, an increase in personnel costs, or both. Moreover, because the input fluid originates from a low pressure fluid line, changes to the input fluid pressure may not be practicable as other devices that operate using a certain range of fluid pressures may also be coupled to the low pressure fluid line.

BRIEF DESCRIPTION OF THE DRAWINGS

Illustrative embodiments of the present disclosure are described in detail below with reference to the attached drawing figures, which are incorporated by reference herein, and wherein.

Figure 1:
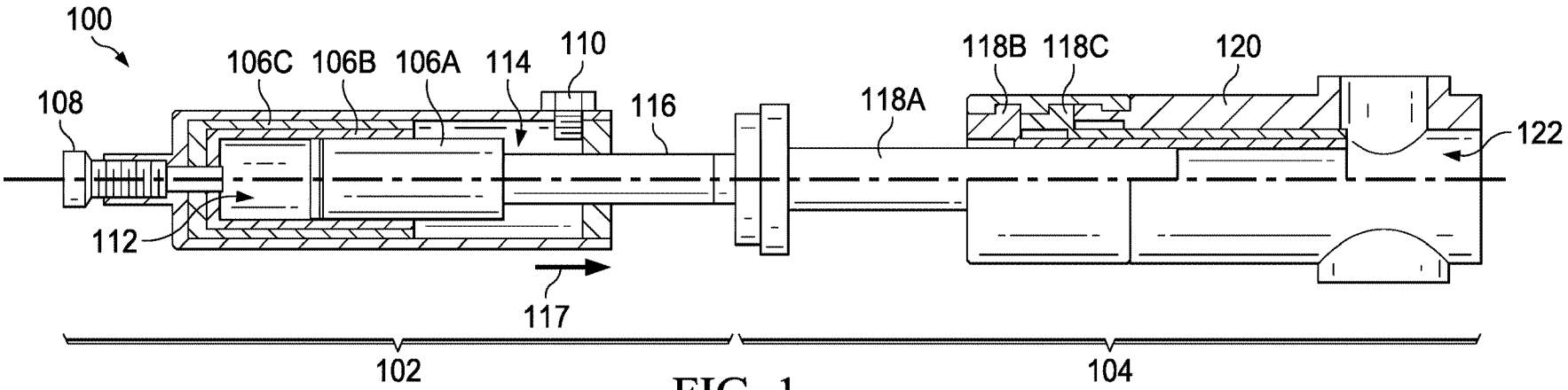
FIG. 1 is a sectional view of an intensifier pump, in accordance with an embodiment of the disclosure.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the singular forms "a", "an," and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the embodiments and figures are merely illustrative and do not imply that any particular step or component is a requirement of a claimed embodiment.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

Further, spatially relative terms, such as beneath, below, lower, above, upper, uphole, downhole, upstream, downstream, and the like, may be used herein for ease of description to describe one element or feature's relationship to another element or feature as illustrated, the upward direction being toward the top of the corresponding figure and the downward direction being toward the bottom of the corresponding figure. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

The present disclosure is related to intensifier pumps and, in particular, to intensifier pumps with modifiable intensities. In some embodiments, the intensifier pumps include multiple adjustable diameters of pistons and plungers that provide adjustments to intensification by the intensifier pump. The resulting intensifier pump provides an operator with the ability to change pump intensity on the fly without changing input pressure originating from a fluid line with a fixed pressure.

The devices described herein may be suitable for use in the oil and gas industry, such as for use in providing fluids downhole during fracturing operations. It will be appreciated, however, that the devices described herein are equally applicable to pumping technologies uses in other technical fields including, but not limited to, automotive, civil, marine, fabrication, water-jetting, aeronautics or medical fields and any other field where it may be desired to intensify fluid pumping pressure. Applications may also include static pressure requirements, such as presses, lifts or semi-motive applications.

Referring to FIG. 1, illustrated is an intensifier pump 100, according to one or more embodiments. As illustrated, the intensifier pump 100 includes a power section 102 and a pressure section 104. The power section 102 includes a modifiable piston 106. The modifiable piston 106 may be modified between pistons 106A, 106B, and 106C with varying diameters. While three different pistons 106A, 106B, and 106C are illustrated in FIG. 1, more or fewer diameters of the piston 106 are also contemplated within the scope of the present disclosure.

An input port 108 receives energizing liquid from an input fluid line, such as a hydraulic fluid line. The energizing liquid may be hydraulic oil, water, or any other clean fluid such as antifreeze. The input port 108 may also operate as a control mandrel to control which of the pistons 106A, 106B, or 106C is used during an intensifier operation. For example, an operator may move the input port 108 within the power section 102 in a direction toward the pressure section 104 to select the piston 106A with the smallest diameter. Additionally, as the operator moves the input port 108 in a direction away from the pressure section 104, the piston 106B or the piston 106C, which include progressively larger diameters, is selected.

Selecting the piston 106B or 106C in place of the piston 106A results in a different intensifier ratio of the intensifier pump 100. For example, as the diameter of the piston 106 increases, the output pressure of the intensifier pump 100 also increases. In an embodiment, the piston 106A may provide an intensification of three times a pressure of the energizing fluid provided to the input port 108, the piston 106B may provide an intensification of four times a pressure of the energizing fluid provided to the input port 108, and the piston 106C may provide an intensification of five times a pressure of the energizing fluid provided to the input port 108 assuming that pressure section 104 remains constant.

As mentioned above, the input port 108 receives input fluid (i.e., energizer liquid) from an input fluid line (not shown). The input fluid enters the intensifier pump 100 at the input port 108, travels to an input cavity 112, and acts on the piston 106A, 106B, or 106C that is selected by the operator based on the position of the input port 108. As the input fluid acts on the selected piston 106, input fluid in an exit cavity 114 is displaced and expelled through an exit port 110. As the input fluid acts on the selected piston 106, a rod 116 extending from the power section 102 moves in a direction 117 toward the pressure section 104.

The pressure section 104 includes a plunger 118. Similar to the piston 106, the plunger 118 may also include a selectable size. For example, the plunger 118 may include three plungers 118A, 118B, or 118C of different diameters that are selectable by the operator of the intensifier pump 100. As illustrated, the plunger 118A is a solid cylinder, while the plungers 118B and 118C are hollow cylinders that are progressively larger than the solid cylinder of the plunger 118A. Accordingly, when the plunger 118B is selected, the plunger 118A is nested within the plunger 118B to generate a larger diameter. Similarly, when the plunger 118C is selected, the plungers 118A and 118B are nested within the plunger 118C to generate a larger diameter. While three plungers 118A, 118B, and 118C are illustrated, more or fewer plungers 118 are also contemplated within the scope of the present disclosure. As the input fluid enters the input port 108 forcing the piston 106 in the direction 117, the rod 116 acts on the plunger 118 in the direction 117. Because a diameter of the plunger 118 is smaller than a diameter of the piston 106, a pressure of working fluid of the intensifier pump 100 is intensified based on a ratio of the surface areas of the piston 106 and the plunger 118. Accordingly, as the plunger 118 moves in the direction 117 within a pump body 120 of the pressure section 104, a pressure of the working fluid within a compression chamber 122 of the pump body 120 increases. In an embodiment, the intensifier pump 100 is capable of outputting a pressure of between 15,000 psi and 30,000 psi from the pressure section 104 of the intensifier pump 100.

Figure 2A:
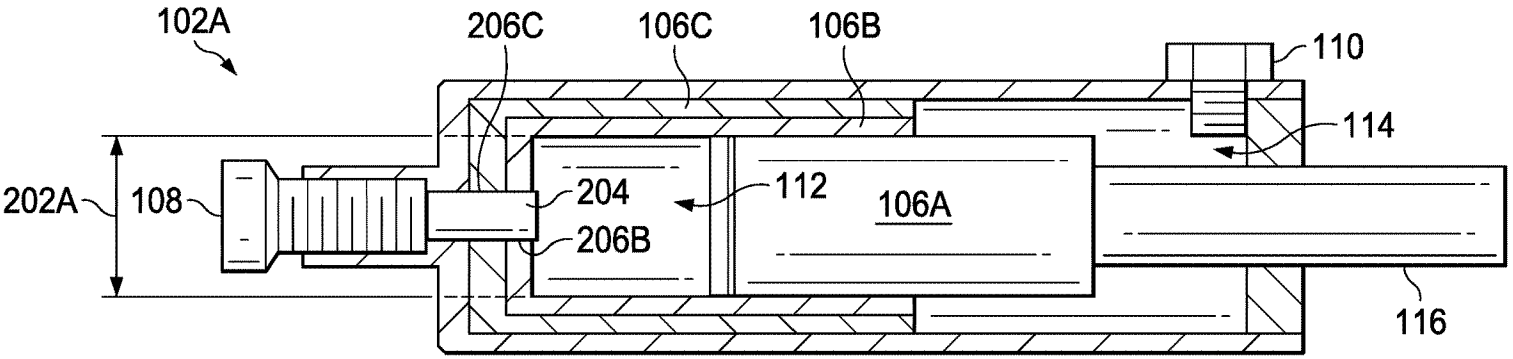
FIGS. 2A-2C are sectional views of a piston of the intensifier pump of FIG. 1 in three different intensity arrangements, in accordance with an embodiment of the disclosure.
Figure 2B:
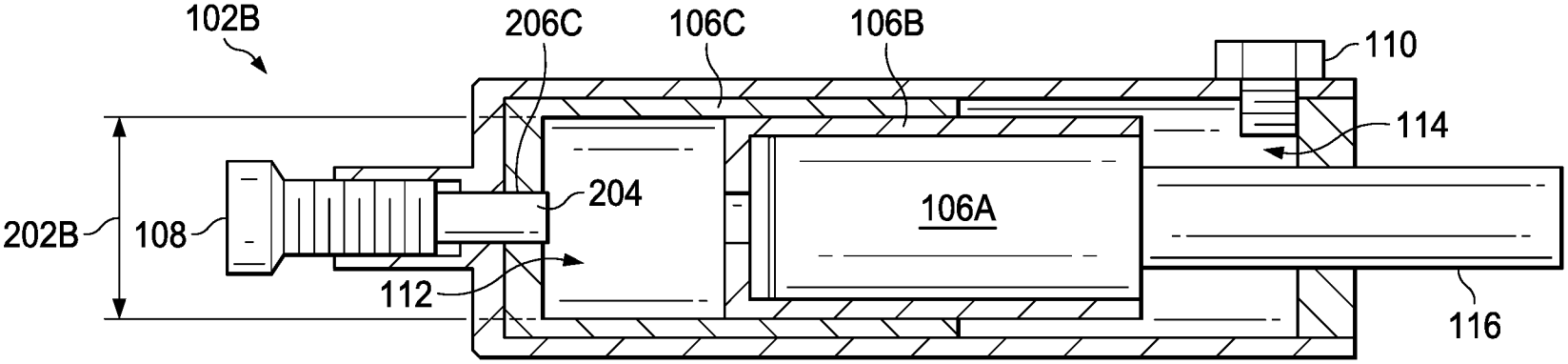
Figure 2C:
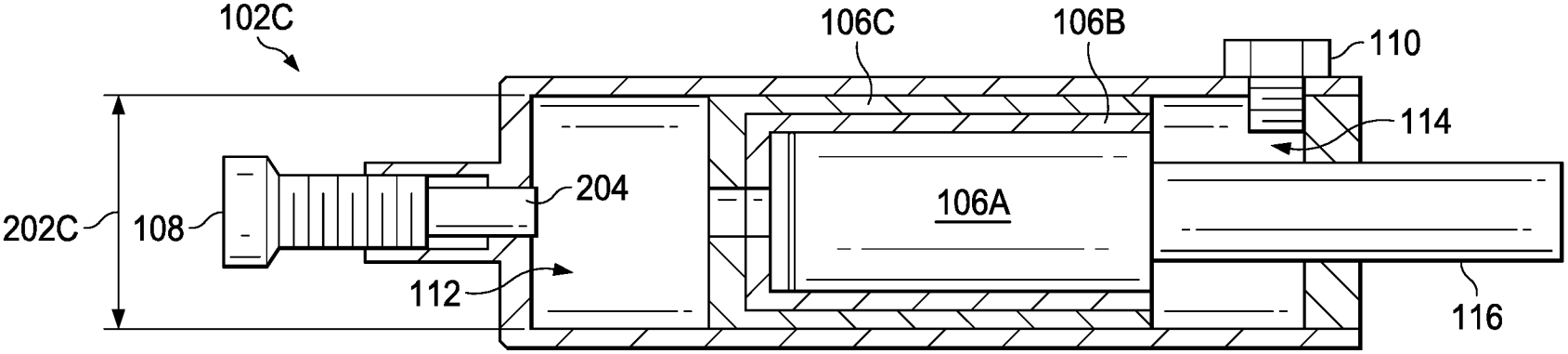

FIGS. 2A-2C are a sectional views of the pistons 106A-C of the intensifier pump 100 in three different intensity arrangements, according to one or more embodiments. By way of example, a power section 102A includes the input port 108 in a position that selects the piston 106A. The piston 106A includes a diameter 202A. The diameter 202A is smaller than diameters 202B and 202C associated with pistons 106B and 106C, respectively. Accordingly, output pressure of the working fluid from the pressure section 104 is less using the power section 102A than the output pressure from the pressure section 104 when using power sections 102B and 102C.

The power section 102B includes the input port 108 in a position that selects the piston 106B. The piston 106B includes the diameter 202B that is larger than the diameter 202A and smaller than the diameter 202C. The piston 106A may fit within the piston 106B such that the piston 106A remains nested within the piston 106B during operation of the intensifier pump 100 when the piston 106B is selected by the input port 108. In selecting the piston 106B, the output pressure of the working fluid from the pressure section 104 will be larger than the output pressure using the power section 102A and smaller than the output pressure using the power section 102C.

The power section 102C includes the input port 108 in a position that selects the piston 106C. The piston 106C includes the diameter 202C that is larger than the diameters 202A and 202B. The pistons 106A and 106B may fit within the piston 106C such that the pistons 106A and 106B remain nested within the piston 106C during operation of the intensifier pump 100 when the piston 106C is selected by the input port 108. In selecting the piston 106C, the output pressure of the working fluid from the pressure section 104 will be larger than the output pressure using either of the power sections 102A or 102B.

To select between the pistons 106A, 106B, and 106C, the input port 108 may include a sealing component, such as an O-ring, in combination with a locking component that is able to lock the input port 108 to the piston 106B or 106C. For example, the input port 108 may be threaded along a portion 204 of the input port 108, and the threads of the input port 108 may match threading along orifices 206B and 206C of the pistons 106B and 106C, respectively. The threading on the portion 204 of the input port 108 and within the orifices 206B and 206C may enable the input port 108 to lock the unwanted pistons 106B and/or 106C in an inoperable position, as illustrated in the power sections 102A and 102B. When the input port 108 does not interact with the pistons 106B and 106C, as in the power section 102C, the piston 106C is selected for operation of the intensifier pump 100.

In the embodiments of FIGS. 2A-2C, pistons are automatically locked into position by pressure differential. For example, the system is in an extended situation using all three pistons 106A-106C, as illustrated in FIG. 2C. At that instance in time, it is decided to reduce pressure capacity to the second position. The input port 108 is quickly repositioned, as represented in FIG. 2B. No pressure change will be experienced at the pump output until the piston moves back completely, thus sealingly engages input port 108 to orifice 206C. Now, pressurizing input port 108 will not be able to move piston 106C anymore, as the right side of orifice 206C is now pressurized. This means that force output of the power section 102 automatically changes at the following forward stroke following reposition of input port 108. Backward stroke of the piston is controlled by the exit port 110.

Figure 3A:
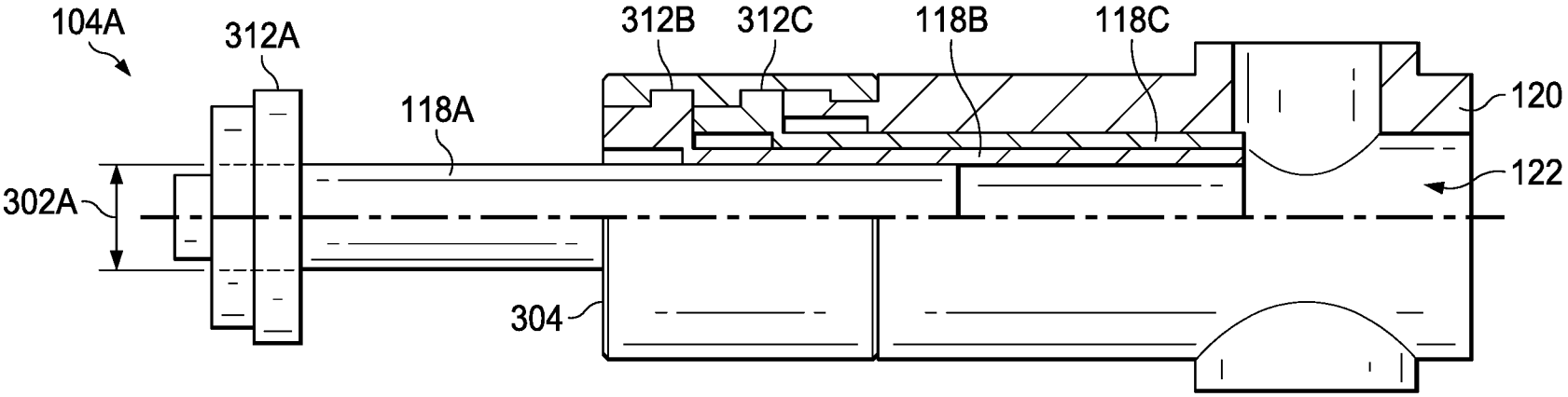
FIGS. 3A-3C are sectional views of a plunger of the intensifier pump of FIG. 1 in three different intensity arrangements, in accordance with an embodiment of the disclosure.
Figure 3B:
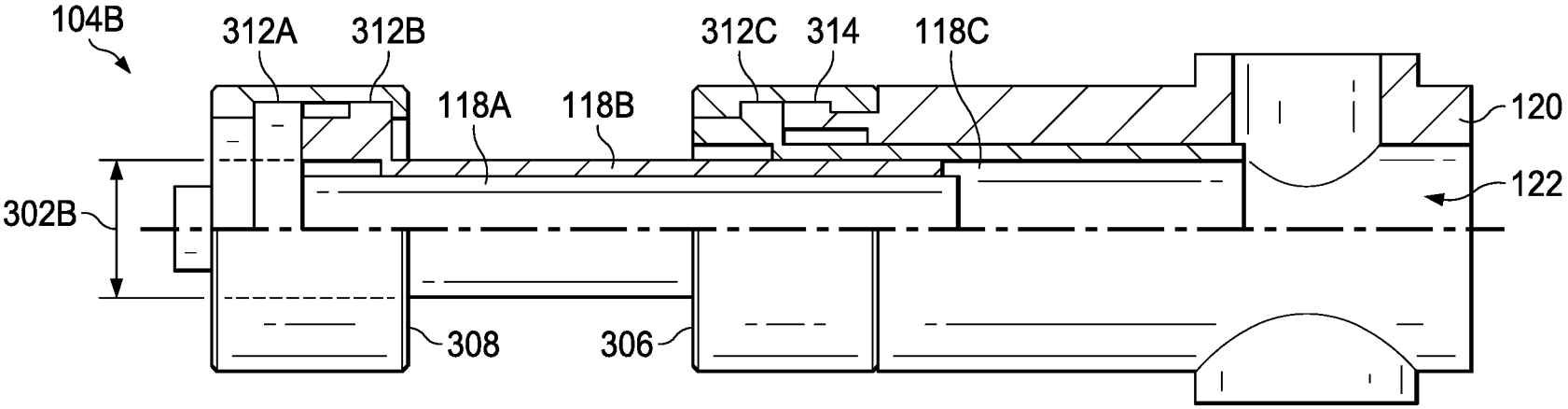
Figure 3C:
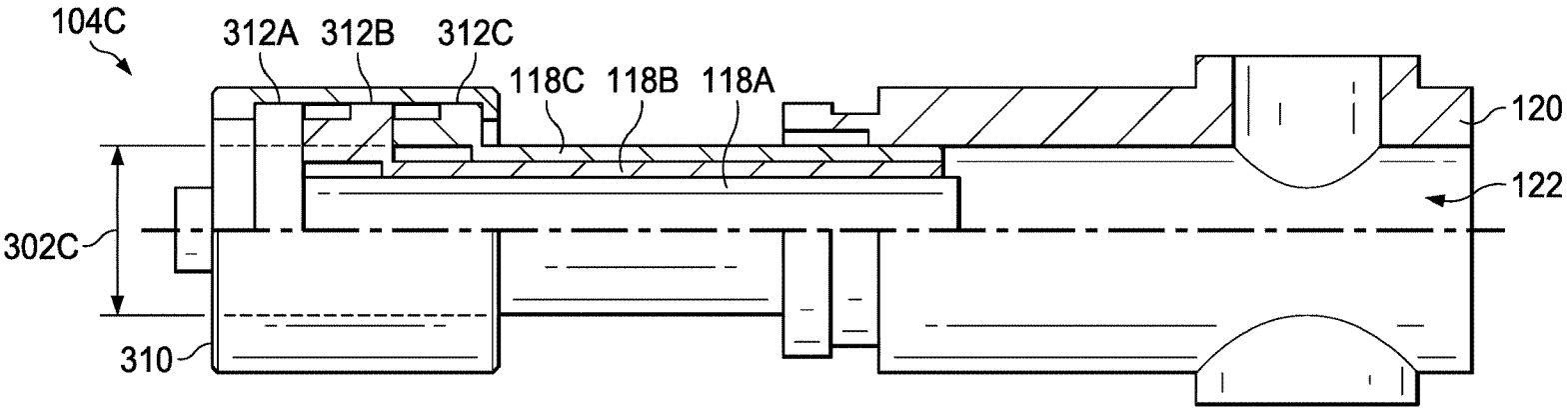

FIGS. 3A-3C are sectional views of the plunger 118 of the intensifier pump 100 in three different intensity arrangements, according to one or more embodiments. By way of example, a pressure section 104A includes the plunger 118A providing the pressure on the working fluid into the pressure chamber 122. The plunger 118A includes a diameter 302A. The diameter 302A is smaller than diameters 302B and 302C associated with the plungers 118B and 118C, respectively. Accordingly, output pressure of the working fluid from the pressure section 104 is greater using the pressure section 104A than the output pressure from the pressure sections 104B and 104C.

The pressure section 104B includes the plunger 118B and 118A providing the pressure on the working fluid in the pressure chamber 122. The plunger 118B includes the diameter 302B that is larger than the diameter 302A and smaller than the diameter 302C. The plunger 118A may fit within the plunger 118B such that the plunger 118A remains nested within the plunger 118B during operation of the intensifier pump 100 when the plunger 118B is selected by an operator. In selecting the plunger 118B, the output pressure of the working fluid from the pressure section 104B is less than the output pressure using the pressure section 104A and greater than the output pressure using the pressure section 104C.

The pressure section 104C includes the plunger 118C, 118A and 118B providing the pressure on the working fluid in the pressure chamber 122. The plunger 118C includes the diameter 302C that is larger than the diameters 302A and 302B. The plungers 118A and 118B may fit within the plunger 118C such that the plungers 118A and 118B remain nested within the plunger 118C during operation of the intensifier pump 100 when the plunger 118C is selected. In selecting the plunger 118C, the output pressure of the working fluid from the pressure section 104C is less than the output pressure using either of the pressure sections 104A or 104B.

To select between the plungers 118A, 118B, and 118C, fastening devices 304, 306, 308, and 310, such as c-clamps or other suitable fastening devices, interact with portions of the plungers 118A, 118B, and 118C. For example, the pressure section 104A includes the fastening device 304, which is depicted as a c-clamp in FIG. 3A, positioned around flanges 312B and 312C of the plungers 118B and 118C, respectively. When the fastening device 304 is positioned over the flanges 312B and 312C, the plunger 118A is used to provide the output pressure to the working fluid in the pressure chamber 122, and plungers 118B and 118C become part of pressure chamber 122; thus effectively reducing the effective diameter of chamber 122 and hence increasing the pressure output of chamber 122.

In the pressure section 104B of FIG. 3B, the fastening devices 306 and 308 are used to select the plunger 118B. The fastening device 306 couples the flange 312C to a flange 314 of the pump body 120. In this manner, the fastening device 306 holds the plunger 118C in a stationary positon up against the pump body 120 and, therefore, plunger 118C becomes part of the pressure chamber 122. Additionally, the fastening device 308 couples a flange 312A of the plunger 118A to the flange 312B of the plunger 118B. In this manner, the fastening device 308 couples the plunger 118A to the plunger 118B to generate the diameter 302B.

In the pressure section 104C of FIG. 3C, the fastening device 310 is used to select the plunger 118C. The fastening device 310 couples all three of the flanges 312A, 312B, and 312C together to generate the diameter 302C of the plunger 118C. Because all three of the plungers 118A, 118B, and 118C are used in the pressure section 104C, there is no fastening device to couple any of the plungers to the pump body 120. While FIGS. 3A-3C depict the fastening devices 304, 306, 308, and 310 as c-clamps or sleeves that fit around the flanges 312A-312C and 314, any other suitable fastening devices are also contemplated within the scope of the present disclosure.

Figure 4A:
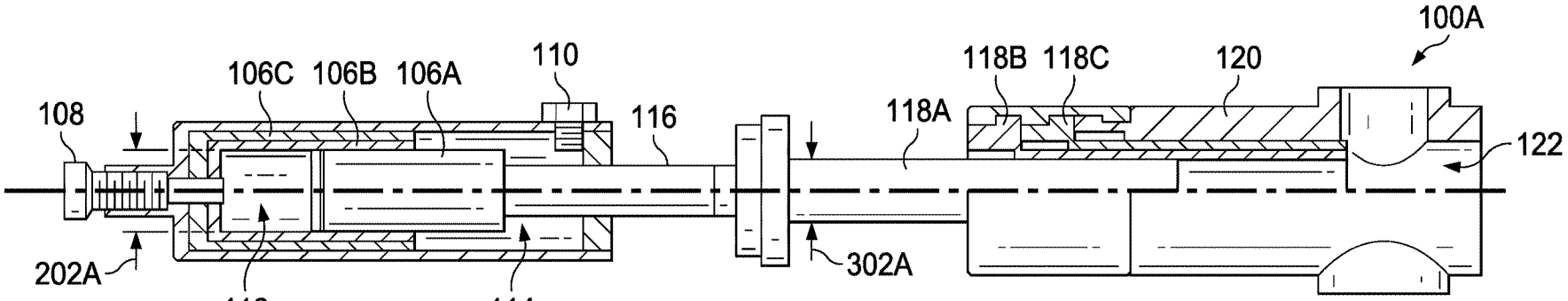
FIGS. 4A-4C are sectional views of the intensifier pump of FIG. 1 in three different intensity arrangements, in accordance with an embodiment of the disclosure.
Figure 4B:
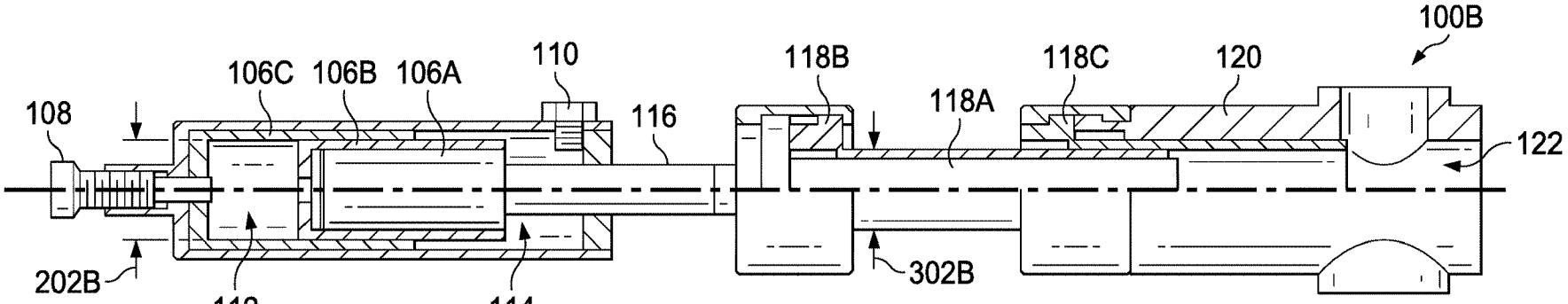
Figure 4C:
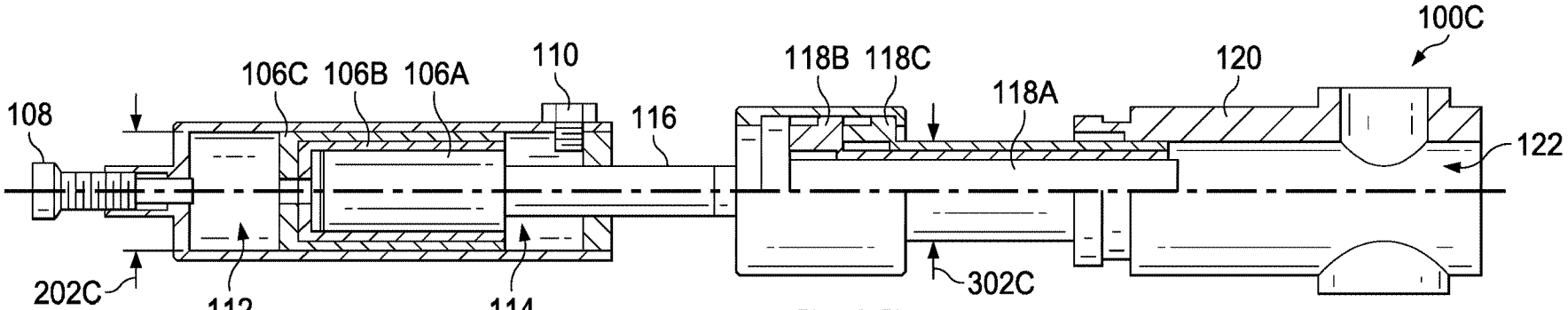

FIGS. 4A-4C are sectional views of the intensifier pump 100 in three different intensity arrangements, according to one or more embodiments. While FIGS. 4A-4C provide three different intensity arrangements, a total of nine intensity arrangements are available when the intensifier pump 100 has three separate diameters 202A-202C of the piston 106 and three separate diameters 302A-302C of the plunger 118. Additionally, other embodiments of the intensifier pump 100 may include more or fewer diameters 202 for the piston 106 and more or fewer diameters 302 of the plunger 118. For example, in an embodiment, the intensifier pump 100 may include five diameters 202 of the piston 106 and two diameters 302 of the plunger 118. In such an embodiment, the intensifier pump 100 includes ten intensity arrangements.

As illustrated in FIGS. 4A-4C, the intensifier pump 100A includes selection of the piston 106A and the plunger 118A. That is, the intensifier pump 100A includes an intensifier arrangement with the smallest diameter 202A of the piston 106 and the smallest diameter 302A of the plunger 118. The intensifier pump 100B includes selection of the piston 106B and the plunger 118B. That is, the intensifier pump 100B includes an intensifier arrangement with the mid-size diameter 202B of the piston 106 and the mid-size diameter 302B of the plunger 118. The intensifier pump 100C includes selection of the piston 106C and the plunger 118C. That is, the intensifier pump 100C includes an intensifier arrangement with the largest diameter 202C of the piston 106 and the largest diameter 302C of the plunger 118. While only three embodiments are illustrated in FIGS. 4A-4C, other arrangements are also contemplated within the scope of this disclosure. For example, the piston 106A may be paired with any of the plungers 118A-118C, the piston 106B may be paired with any of the plungers 118A-118C, and the piston 106C may be paired with any of the plungers 118A-118C.

Figure 5:
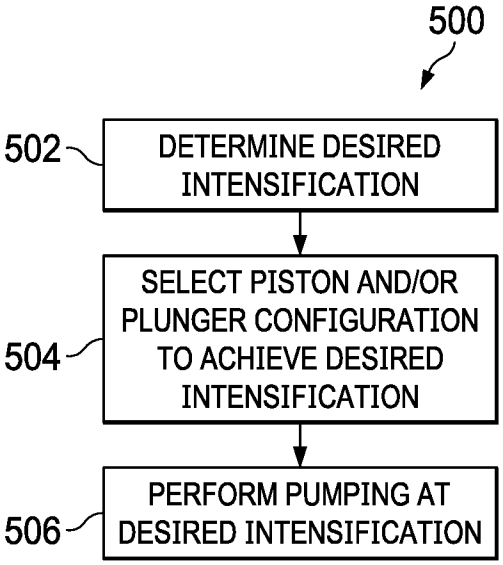
FIG. 5 is a flowchart of a method of setting an intensity arrangement of the intensifier pump of FIG. 1, in accordance with an embodiment of the disclosure.

FIG. 5 is a flowchart of a method 500 of setting an intensity arrangement of the intensifier pump 100, in accordance with one or more embodiments of the disclosure. Initially, at block 502, a desired intensification is determined. By way of example, an operator may decide on a pressure of the working fluid to be approximately 20,000 psi.

Subsequently, at block 504, configuration of the piston 106 and/or plunger 118 of the intensifier pump may be selected to generate the 20,000 psi pressure. For example, when the pressure of the hydraulic fluid entering the power section 102 is 5,000 psi, to achieve the 20,000 psi pressure of the working fluid, a 4 to 1 ratio between a surface area of the piston 106 to the surface area of the plunger 118 may be selected. That is, the piston 106 is selected with a surface area four times greater than a surface area of the selected plunger 118. Other pressures and ratios are also contemplated within the scope of the present disclosure. At block 506, pumping of the intensifier pump 100 is performed at the selected intensification level.

In one or more embodiments, only the piston 106 or the plunger 118 may have multiple selectable diameters 202 or 302, respectively. In such an embodiment, the method 500 may rely on only changes to the piston diameter 202 or to the plunger diameter 302 to produce the desired pressure ratio. Further, selection of the piston 106 and/or the plunger 118 to achieve a desired pressure ratio may be accomplished using an automated system. That is, a processor may receive instructions that in operation cause the processor to identify the appropriate piston 106 and/or plunger 118, and to instruct a mechanism to physically select the identified piston 106 and/or plunger 118. It is also possible that only one portion of the combined system is selected without implementing the other. The adjustability of the piston is simple, so it may be selected on its own without the improvement of the pressure end, i.e., the plunger modifications. However, a mechanical connection using clamps may be considered more reliable, as it is fixed for a desired duration.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. Moreover, the separation of various system components in the embodiments described above should not be understood as requiring such separation in all embodiments.

Furthermore, the exemplary methodologies described herein may be implemented by a system including processing circuitry or a computer program product including instructions which, when executed by at least one processor, causes the processor to perform any of the methodology described herein.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowchart depicts a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, an intensifier pump, comprising: a piston comprising at least two selectable piston diameters; and a plunger configured to interact with the piston, wherein the plunger comprises a plunger diameter that is smaller than each of the at least two selectable piston diameters.

Clause 2, the intensifier pump of clause 1, wherein the plunger comprises a second selectable plunger diameter that is smaller than each of the at least two selectable piston diameters.

Clause 3, the intensifier pump of clause 1 or 2, wherein the at least two selectable piston diameters comprise a first piston diameter and a second piston diameter, and wherein the first piston diameter generates a first output pressure at the plunger four times greater than an input pressure of an energizing fluid, and the second piston diameter generates a second output pressure at the plunger five times greater than the input pressure of the energizing fluid.

Clause 4, the intensifier pump of at least one of clauses 1-3, comprising: an input port, wherein the input port is configured to select between the at least two selectable piston diameters.

Clause 5, the intensifier pump of at least one of clauses 1-4, wherein the input port selects between the at least two selectable piston diameters by moving toward the plunger or away from the plunger.

Clause 6, the intensifier pump of at least one of clauses 1-5, wherein the input port comprises threading at one end, and the threading is configured to interact with the piston to select between the at least two selectable piston diameters.

Clause 7, the intensifier pump of at least one of clauses 1-6, wherein the input port is configured to receive energizing liquid from a hydraulic fluid line that provides hydraulic pressure to the piston.

Clause 8, the intensifier pump of at least one of clauses 1-7, wherein the piston comprises a first piston body with a first piston diameter and a second piston body with a second diameter, wherein the first piston body is configured to nest within the second piston body.

Clause 9, the intensifier pump of at least one of clauses 1-8, wherein the piston comprises a first piston body, a second piston body, and a third piston body, and the first piston body and the second piston body are configured to nest within the third piston body.

Clause 10, the intensifier pump of at least one of clauses 1-9, wherein the plunger is configured to output pressure up to 30,000 psi.

Clause 11, an intensifier pump, comprising: an input port to receive input fluid; a piston comprising a piston diameter; and a plunger configured to interact with the piston, wherein the plunger comprises at least two selectable plunger diameters and each of the at least two selectable plunger diameters is smaller than the piston diameter.

Clause 12, the intensifier pump of clause 11, wherein the plunger comprises a set of flanges, and the at least two selectable plunger diameters are selectable using a clamp interacting with the set of flanges.

Clause 13, the intensifier pump of clause 11 or 12, wherein the plunger comprises a solid cylinder of a first diameter and a hollow cylinder of a second diameter, wherein the solid cylinder is configured to nest within the hollow cylinder to provide the plunger with the second diameter.

Clause 14, the intensifier pump of at least one of clauses 11-13, wherein the solid cylinder comprises a first flange and the hollow cylinder comprises a second flange, and wherein the second diameter is selected by clamping the first flange to the second flange.

Clause 15, the intensifier pump of at least one of clauses 11-14, wherein the plunger is configured to output pressure up to 30,000 psi.

Clause 16, an intensifier pump, comprising: an inlet configured to receive inlet fluid at a first pressure; a piston comprising at least two selectable piston diameters, wherein the inlet fluid exerts pressure on the piston; a plunger configured to interact with the piston, wherein the plunger comprises at least two selectable plunger diameters and each of the at least two selectable plunger diameters is smaller than each of the at least two selectable piston diameters; and an outlet configured to output an outlet fluid at a second pressure greater than the first pressure, wherein the plunger exerts the second pressure on the outlet fluid.

Clause 17, the intensifier pump of clause 16, wherein the inlet is configured to select between the at least two selectable piston diameters.

Clause 18, the intensifier pump of clause 16 or 17, wherein the plunger comprises a first flange associated with a first selectable plunger diameter and a second flange associated with a second selectable plunger diameter, and the at least two selectable plunger diameters are selected by clamping and unclamping the first flange and the second flange.

Clause 19, the intensifier pump of at least one of clauses 16-18, wherein the second pressure is between 15,000 psi and 30,000 psi.

Clause 20, An intensifier pump, comprising an inlet configured to receive an inlet fluid at a first pressure; and a piston comprising at least two selectable piston diameters, and the inlet fluid exerting pressure on the piston at the first pressure; an inlet mandrel adjustable to connect to a specific one of the at least two piston diameters; and a plunger configured to interact with the piston.

While this specification provides specific details related to intensifier pumps, it may be appreciated that the list of components is illustrative only and is not intended to be exhaustive or limited to the forms disclosed. Other components related to the intensifier pumps will be apparent to those of ordinary skill in the art without departing from the scope and spirit of the disclosure. Further, the scope of the claims is intended to broadly cover the disclosed components and any such components that are apparent to those of ordinary skill in the art.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. An intensifier pump, comprising:

a piston comprising at least two selectable piston diameters;

an inlet mandrel, wherein the inlet mandrel is configured to select between the at least two selectable piston diameters: and a plunger configured to interact with the piston, wherein the plunger comprises a plunger diameter that is smaller than each of the at least two selectable piston diameters.

2. The intensifier pump of claim 1, wherein the at least two selectable piston diameters comprise a first piston diameter and a second piston diameter, and wherein the first piston diameter generates a first output pressure at the plunger four times greater than an input pressure of an energizing fluid, and the second piston diameter generates a second output pressure at the plunger five times greater than the input pressure of the energizing fluid.

3. The intensifier pump of claim 1, wherein the inlet mandrel selects between the at least two selectable piston diameters by moving toward the plunger or away from the plunger.

4. The intensifier pump of claim 1, wherein the inlet mandrel comprises threading at one end, and the threading is configured to interact with the piston to select between the at least two selectable piston diameters.

5. The intensifier pump of claim 1, wherein the inlet mandrel is configured to receive energizing liquid from a hydraulic fluid line that provides hydraulic pressure to the piston.

6. The intensifier pump of claim 1, wherein the piston comprises a first piston body with a first piston diameter and a second piston body with a second diameter, wherein the first piston body is configured to nest within the second piston body.

7. The intensifier pump of claim 1, wherein the piston comprises a first piston body, a second piston body, and a third piston body, and the first piston body and the second piston body are configured to nest within the third piston body.

8. The intensifier pump of claim 1, wherein the plunger is configured to output pressure up to 30,000 psi.

9. A kit for selectively adjusting the output pressure of an intensifier pump, comprising:

an intensifier pump, comprising:

an input port to receive input fluid;

a piston comprising a piston diameter; and a plunger configured to interact with the piston, wherein the plunger comprises at least two selectable plunger diameters and each of the at least two selectable plunger diameters is smaller than the piston diameter, the at least two selectable plunger diameters comprising a first plunger diameter and a second plunger diameter, and the plunger comprises a set of flanges, each of the set of flanges being capable of moving together with a stroke movement of the plunger, and a plurality of clamps configured to interact with the flanges to selectively enable the plunger to reciprocate with the first plunger diameter or the second plunger diameter.

10. The intensifier pump of claim 9, wherein the plunger comprises a solid cylinder of the first plunger diameter and a hollow cylinder of the plunger second diameter, wherein the solid cylinder is configured to nest within the hollow cylinder to provide the plunger with the second plunger diameter.

11. The intensifier pump of claim 10, wherein the solid cylinder comprises a first flange of the set of flanges and the hollow cylinder comprises a second flange of the set of flanges, and wherein the second diameter is selected by clamping the first flange to the second flange.

12. The intensifier pump of claim 9, wherein the plunger is configured to output pressure up to 30,000 psi.

13. A kit for selectively adjusting the output pressure of an intensifier pump, comprising:

the intensifier pump, the intensifier pump comprising:

an inlet mandrel configured to receive inlet fluid at a first pressure; wherein the inlet mandrel is configured to select between at least two selectable piston diameters;

a piston comprising the at least two selectable piston diameters, wherein the inlet fluid exerts pressure on the piston;

a plunger configured to interact with the piston, wherein the plunger comprises at least two selectable plunger diameters and each of the at least two selectable plunger diameters is smaller than each of the at least two selectable piston diameters, the at least two selectable plunger diameters comprising a first plunger diameter and a second plunger diameter, and an outlet configured to output an outlet fluid at a second pressure greater than the first pressure, wherein the plunger exerts the second pressure on the outlet fluid, and a plurality of fastening devices configured to selectively enable the plunger to reciprocate with the first plunger diameter or the second plunger diameter.

14. The intensifier pump of claim 13, wherein the plunger comprises a first flange associated with a first selectable plunger diameter and a second flange associated with a second selectable plunger diameter, and the at least two selectable plunger diameters are selected by clamping and unclamping the first flange and the second flange.

15. The intensifier pump of claim 13, wherein the second pressure is between 15,000 psi and 30,000 psi.

16. An intensifier pump, comprising:

an inlet configured to receive an inlet fluid at a first pressure;

a piston comprising at least two selectable piston diameters, and the inlet fluid exerting pressure on the piston at the first pressure;

an inlet mandrel adjustable to connect to a specific one of the at least two piston diameters to select the specific one of the at least two piston diameters; and a plunger configured to interact with the piston.

17. The intensifier pump of claim 16, wherein the input mandrel selects between the at least two selectable piston diameters by moving toward the plunger or away from the plunger.

18. The intensifier pump of claim 16, wherein the input mandrel comprises threading at one end, and the threading is configured to interact with the piston to select between the at least two selectable piston diameters.

19. The intensifier pump of claim 16, wherein the input mandrel is configured to receive energizing liquid from a hydraulic fluid line that provides hydraulic pressure to the piston.

20. The intensifier pump of claim 16, wherein the piston comprises a first piston body with a first piston diameter and a second piston body with a second diameter, wherein the first piston body is configured to nest within the second piston body.

* * * * *